US010479654B2

(12) United States Patent
Klapper

(10) Patent No.: US 10,479,654 B2
(45) Date of Patent: Nov. 19, 2019

(54) CRANE GIRDER FOR A CRANE

(71) Applicant: Hans Künz GmbH, Hard (AT)

(72) Inventor: Georg Klapper, Hard (AT)

(73) Assignee: Hans Künz GmbH, Hard (AT)

( * ) Notice: Subject to any disclaimer, the term of this patent is extended or adjusted under 35 U.S.C. 154(b) by 247 days.

(21) Appl. No.: 15/312,200

(22) PCT Filed: May 19, 2015

(86) PCT No.: PCT/AT2015/000075
§ 371 (c)(1),
(2) Date: Nov. 18, 2016

(87) PCT Pub. No.: WO2015/179887
PCT Pub. Date: Dec. 3, 2015

(65) Prior Publication Data

US 2017/0081153 A1 Mar. 23, 2017

(30) Foreign Application Priority Data

May 26, 2014 (AT) ..... A 408/2014

(51) Int. Cl.
*B66C 6/00* (2006.01)
*B66C 19/00* (2006.01)

(52) U.S. Cl.
CPC ..... *B66C 6/00* (2013.01); *B66C 19/00* (2013.01)

(58) Field of Classification Search
CPC . B66C 6/00; B66C 7/00–16; B66C 17/00–26; B66C 19/00–02
See application file for complete search history.

(56) References Cited

U.S. PATENT DOCUMENTS 3,294,252 A 12/1966 Hosoi et al.
4,611,158 A 9/1986 Nagase et al.
5,735,416 A 4/1998 Jussila

FOREIGN PATENT DOCUMENTS

BE 733982 11/1969
CN 201236414 5/2009
(Continued)

OTHER PUBLICATIONS

"Kuhnezug" German Cranes, Internet page, (May 2013) (admitted prior art).

(Continued)

*Primary Examiner* — Sang K Kim
*Assistant Examiner* — Nathaniel L Adams
(74) *Attorney, Agent, or Firm* — Volpe and Koenig, P.C.

(57) ABSTRACT

Crane girder (1) for a crane (3), wherein the crane girder (1) includes a hollow profile (4) having an outer wall (6) enclosing a cavity (5) and extends longitudinally, and the outer wall (6) of the crane girder (1), as seen in a cross-section through the crane girder (1), has a shape which bulges outwards at least in some regions in order to reduce aerodynamic drag, wherein the outer wall (6), as seen in the cross-section through the crane girder (1), has two sections (10, 11) facing one another with an outwards bulging shape, which are joined together by two straight wall sections (12) of the outer wall (6), these straight wall sections face one another, and the crane girder (1) has at least one running surface (13) for at least one running wheel (14) of a trolley (15) of a lifting tool of the crane (3), wherein the sections (10, 11) facing one another with an outwards bulging shape point upwards and downwards in an operating position of the crane girder and the straight wall sections (12) delimit the crane girder (1) on the sides.

8 Claims, 4 Drawing Sheets

(56) References Cited

FOREIGN PATENT DOCUMENTS

| | | | | | |
|---|---|---|---|---|---|
| CN | 201932823 | | | 8/2011 | |
| CN | 102515021 | | | 6/2012 | |
| CN | 202785363 | | | 3/2013 | |
| CN | 103397740 | | | 11/2013 | |
| DE | 1117279 | | | 11/1961 | |
| DE | 8334842 | | | 3/1984 | |
| DE | 3723324 | | | 12/1988 | |
| DE | 4432330 | | | 3/1996 | |
| DE | 10206005 | | | 6/2003 | |
| EP | 0141318 | | | 5/1985 | |
| EP | 0194615 | | | 9/1986 | |
| EP | 0293789 | | | 12/1988 | |
| EP | 0307779 | | | 11/1991 | |
| FR | 1305798 | A | * | 10/1962 | ..... B66C 6/00 |
| JP | S59159687 | | | 10/1984 | |
| JP | 2005239422 | | | 9/2005 | |
| JP | 2011515301 | | | 5/2011 | |
| RU | 1794870 | | | 2/1993 | |

OTHER PUBLICATIONS

Nov. 13, 2011 Hafia Port sees overwhelming surge in traffic, Israel GPO, Jun. 14, 2011, http://www.imagesofmythoughts.com/News/News-2011/20111113-Haria-Port-sses/i-Wq2wGwj. (admitted prior art).

Picture 1 of Hafia port, (May 2013) (admitted prior art).

Picture 2 of Hafia port, (May 2013) (admitted prior art).

KROCKS Krane International Unternehmensprasentation, Catalogue, undated (admitted prior art).

* cited by examiner

CRANE GIRDER FOR A CRANE

BACKGROUND

The present invention relates to a crane girder for a crane, wherein the crane girder has a hollow profile, having an external wall that encloses a cavity, and extends longitudinally, and the external wall of the crane girder, when viewed in a cross section through the crane girder, has at least in regions an outwardly bulging shape for reducing the aerodynamic drag, wherein the external wall, when viewed in the cross section through the crane girder, has two mutually opposite portions, having an outwardly bulging shape, which are interconnected by two mutually opposite straight wall portions of the external wall, and the crane girder has at least one running surface for at least one running wheel of a trolley of a lifting gear of the crane.

In the case of crane girders for in particular large cranes or cranes that have to carry heavy loads, respectively, such as gantry cranes, overhead cranes, or outrigger cranes, the crane girders in the prior art are often configured in the manner of the so-called box construction as a hollow profile. This hollow profile has a cavity and an external wall enclosing this cavity. In the prior art, the external walls are typically assembled in a square cross section from planar sheet-metal panels. In order for yielding or bending of the sheet-metal panels under pressure or shear stress as a result of stability issues to be prevented, reinforcement strips in the form of so-called buckling braces which extend in the longitudinal direction of the crane are typically fastened, in particular welded, internally to the external wall in the prior art. The number of buckling braces may vary very much and typically be between 2 and 20, depending on the size of the girder. The disadvantage of these buckling braces lies in that they increase the weight of the crane girder, on the one hand, and also increase the production effort in the manufacturing of the crane girder, on the other hand.

A crane girder in the form of a box construction, in which the two lateral web panels are configured as concave, inwardly curved shells in order for the torsional rigidity to be increased is known from DE 37 23 324 A1.

A crane girder which has a hollow profile which is bent in a circular manner, wherein two mutually opposite portions having an outwardly bulging shape are interconnected by means of straight wall portions is shown in DE 1 117 279 B. The straight wall portions form a downwardly open slot in which the crane-girder running rails and the trolley are disposed.

Crane girders having a circular cross section are shown in U.S. Pat. No. 3,294,252 A, wherein the respective running surfaces are disposed in a central region on the apex of the circular cross section.

A crane girder having a circular cross section for unilaterally protruding trolleys is shown in EP 0 194 615 A1. The introduction of force into the crane girder is performed tangentially, the crane girder therefore being subject not only to bending stress but also to torsional stress.

SUMMARY

It is therefore an object of the invention to improve a crane girder of the type mentioned above with a view to minimizing the drive power that is required for moving the crane girder and for high forces to thereby be able to be introduced into the crane girder with minimal deformation of the crane girder.

To this end it is provided according to the invention that the mutually opposite portions, having an outwardly bulging shape, in an operating position of the crane girder point upward and downward, and the straight wall portions in the operating position laterally delimit the crane girder, wherein the wall portions extend vertically, and the running surface is disposed and/or supported on, preferably on top of, one of the straight wall portions of the external wall.

By way of the at least in regions outwardly bulging shape of the external wall when viewed in said cross section through the crane girder, which thus deviates from a rectangle, an aerodynamic improvement may be implemented such that the wind stress that acts on the crane girder when the latter is being moved is reduced by a reduction of the aerodynamic drag. Due to this, the drive power which is required for moving the crane girder may be significantly reduced. The crane girders according to the invention are made in the manner of a box construction such that they also have a hollow profile having an external wall enclosing a cavity. The at least in regions outwardly bulging shape for reducing the aerodynamic drag could also be referred to as an at least in regions aerodynamic, outwardly bulging shape.

The portions that in the operating position of the crane girder point upward or downward may be embodied as so-called top booms and lower booms. These may then serve for absorbing and transferring the bending momentums that are created by the introduction of stress into the crane girder and by the dead weight of the crane girder. A particularly high stability at a relatively low weight of the crane girder is achieved in particular in such design embodiments by the outwardly bulging shape.

The straight wall portions which interconnect the two mutually opposite portions having an outwardly curved shape may also be referred to as webs or as lateral webs.

In addition to the improvement in aerodynamics, or in terms of reducing the aerodynamic drag of the crane girder, a static improvement is also achieved by the in regions outwardly bulging shape of the crane girder. By way of the in regions outwardly bulging shape of the external wall, the stability of the crane girder is increased in relation to a rectangular cross section of the external wall having the same material and the same wall thickness. Due to this, the application of reinforcement elements in the form of the buckling braces mentioned at the outset to the external wall may be entirely or at least partially dispensed with. Due to this, a higher stability and thus a load capacity of the crane girder is achieved without an increase in the weight of the crane girder. It is nevertheless to be pointed out that, if this appears expedient in special design embodiments for static reasons, for example, in order to support the external wall, or for other reasons, for example those simplifying the manufacturing of the crane girder, internal walls may additionally also be disposed within the cavity surrounded by the external wall.

Preferred variants of a crane girder according to the invention, having the running surface mentioned, in the operating position of the crane girder favorably run in a substantially horizontal manner. A substantially horizontal manner in this context is to be favorably understood as the horizontal per se, and a deviation therefrom by maximum +/−5°, preferably by +/−1°, from the horizontal. Crane girders on which the running wheels of the trolley for the lifting gear of the crane are supported are also often referred to as the main girder of the crane. In the case of such main girders, the invention offers the advantage that the wheel loads of the running wheels of the trolley may be well absorbed by the crane girder.

By way of the running surface or the rail, respectively, being supported on the wall portions that, when viewed in the operating position, are preferably vertically disposed, it is in particular readily possible for the wheel loads of the running wheels to be introduced into the crane girder in an optimal manner. In the case of such design embodiments it is in particular possible for the wheel loads to be introduced into the crane girder at any point along the running surface of the crane girder, even when no partition plate or any other additional substructure is available there.

Crane girders according to the invention are elongate, that is to say that the longitudinal extent thereof is significantly greater than the width extent and thickness extent thereof. As is known per se in the prior art, preferred design embodiments of crane girders according to the invention provide that so-called partition plates are disposed at a certain spacing in the cavity along the longitudinal extent of the crane girder, on which partition plates the external wall is supported or fastened, respectively. The partition plates are favorably disposed such that the former are normal, that is to say orthogonal to the direction of the longitudinal extent of the crane girder. The spacing of the partition plates may be chosen according to requirements.

A further advantage of the at least in regions outwardly bulging shape of the external wall of the crane girder lies in that the creation of noises or the like that are created by wind and/or vibrations is significantly reduced in relation to conventional crane girders having a rectangular cross section of the external wall.

Moreover, the stability against overturning of the crane girder and/or of the crane, for example in the event of a storm, is also increased by the invention.

Particularly preferred exemplary embodiments of the invention provide that the external wall of the crane girder, when viewed in a cross section through the crane girder, has an outwardly bulging shape throughout.

The crane girder is typically moved by the crane in at least one movement direction in relation to the surrounding air thereof. Herein, the entire crane including the crane girder may be moved, and/or the crane girder is moved in relation to the other components of the crane. Based on the concept of as high a reduction as possible of the aerodynamic drag of the crane girder when being moved in the movement direction it is provided in preferred design embodiments of the invention that a width extent of the external wall of the crane girder is delimited in parallel with the movement direction by a first end and a second end of the width extent of the external wall, and when viewed in the cross section through the crane girder a spacing, which is measured orthogonally to the movement direction, between two mutually opposite portions of the external wall at least in regions increases from at least one of the ends of the width extent, preferably from both ends of the width extent, of the cavity toward a central region of the cavity. Of course, there may also be exemplary embodiments in the case of which the crane girder may be moved in two or more movement directions. In such variants, the abovementioned applies to at least one of the movement directions and preferably to that movement direction in which the crane girder is most often moved, or in which the highest wind stress is to be expected, respectively. Since the reduction of the aerodynamic drag is a central concern, the focal issue of the movement direction is always a relative movement between the crane girder and the surrounding air. When the abovementioned movement direction is being established, the locally prevailing main wind direction may therefore also be considered for example. In this sense, the abovementioned principle is even applicable in the case of crane girders or cranes, respectively, that are disposed in a locationally fixed manner.

The outwardly bulging shape of the external wall may also be referred to as an outwardly curved shape of the external wall, wherein this outwardly bulging or curved shape, respectively, may be but need not be embodied in a rounded manner. There are thus the most varied design embodiments for the at least in regions outwardly bulging shape of the external wall. For example, it is possible for the at least in regions outwardly bulging or curved shape of the external wall, when viewed in the cross section through the crane girder, to be configured to be rounded. Alternatively, or in other regions of the external wall, it is also possible that the at least in regions outwardly bulging shape of the external wall, when viewed in the cross section through the crane girder, is configured to be polygonal.

An upwardly bulging shape furthermore has the advantage that no or only little rain water or other precipitation may accumulate on the crane girder and thus no or only a minor additional stress of the crane girder by rain water lying thereon may be created. In order for the load of precipitation bearing thereon to be avoided it may also be provided that the crane girder in the operating position is disposed so as to be slightly inclined in the longitudinal direction of the former. Those portions of the external wall of the crane girder that, when viewed in the mentioned cross section, are configured having an outwardly bulging shape may in portions be configured so as to be curved in a circular-arc shape or any curved shape. As has been mentioned above, polygonal lines or other shapes of the bulge are also conceivable.

Preferred design embodiments of the invention provide that a width extent of the external wall of the crane girder in parallel with the movement direction is larger or smaller than a thickness extent of the external wall of the crane girder that is orthogonal to the movement direction. Herein, the width extent and the thickness extent are in each case the maximum extent of the external wall in the respective direction mentioned. Favorably, the longitudinal extent of the crane girder, and the width extent of the external wall, and the thickness extent of the external wall are in each case mutually orthogonal.

If the width extent of the external wall in a horizontal direction, when viewed in the mentioned cross section, is larger than the thickness extent in a vertical direction, this is typically particularly favorable in the context of a reduction of the wind stress. Designing the thickness extent of the external wall to be larger in the vertical direction than the width extent thereof in the horizontal direction may be expedient when particularly high static requirements are to be set for the crane girder. It is provided in preferred design embodiments that the thickness extent of the external wall in the vertical direction, when viewed in the mentioned cross section of the crane girder, is between 50% and 80% of the width extent of the external wall in the horizontal direction. In the case of large cranes such as, for example, gantry cranes or overhead cranes, in the case of which crane girders according to the invention are employed as main girders having the longitudinal direction thereof aligned so as to be mostly substantially horizontal, the width extent of the external wall in the horizontal direction, when viewed in the mentioned cross section through the crane girder, may have values of 2.5 m to 10 m, preferably of 3 m to 6 m. The length of the crane girders may be from 10 m to 150 m, for example. In the case of straight wall portions or webs being provided in the external wall, respectively, the thickness of the former in the operating position, when viewed in the vertical direction, is favorably between 20 to 60%, preferably between 30 and 40%, of the mentioned thickness extent of the external wall in the vertical direction. Even as the width extent of the external wall runs in the horizontal direction, and the thickness extent of the external wall runs in the vertical direction, in preferred design embodiments, this of course does not have to be mandatory.

The external wall in preferred design embodiments, when viewed in the cross section through the crane girder, is axially symmetrical at least in relation to a symmetry axis. The abovementioned movement direction is favorably parallel with the or with one of the symmetry axes. The cross section through the crane girder is preferably viewed in a plane to which the longitudinal extent of the crane girder runs in a normal or orthogonal manner, respectively. The external wall of the crane girder is preferably partially or entirely comprised of steel. Steel panels having thicknesses between 8 and 20 mm are favorably employed for manufacturing the external wall.

Crane girders according to the invention may be employed in the most diverse types of cranes.

Apart from the crane girder per se, the invention also relates to a crane which has at least one crane girder according to the invention. This herein is particularly preferably a gantry crane or an overhead crane or an outrigger crane. The crane girders according to the invention of the crane may be both supports that run in a substantially vertical manner, for example for connecting a running gear of the crane to a main girder, as well as main girders that run in a substantially horizontal manner. In the case of a gantry crane or of an overhead crane, the crane according to the invention may have a single or else two or more main girders in the form of crane girders according to the invention.

BRIEF DESCRIPTION OF THE DRAWINGS

Further features and details of preferred design embodiments of the invention are illustrated in the appended illustrations in the form of various variants. In the drawing.

DETAILED DESCRIPTION OF THE PREFERRED EMBODIMENTS

Figure 1:
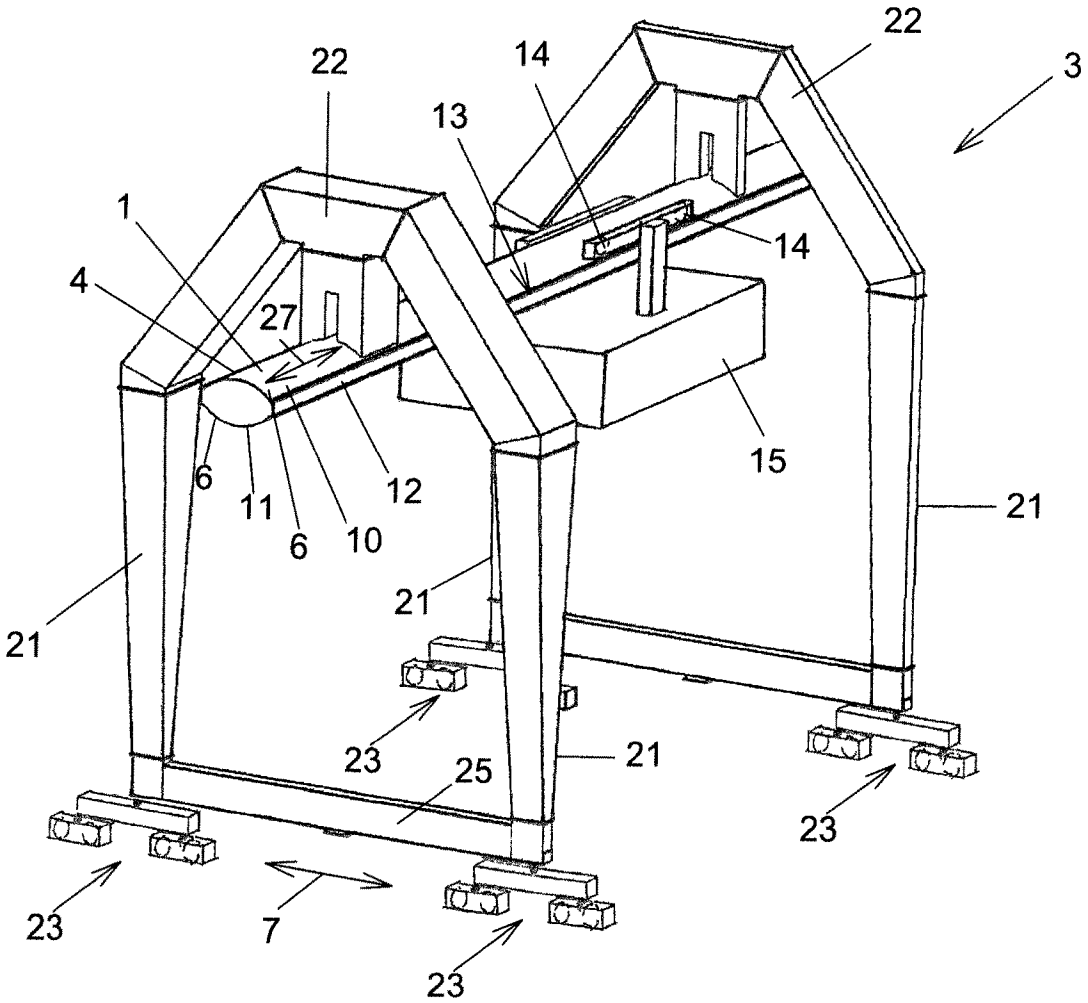
FIGS. 1 to 3 show various design embodiments of cranes having crane girders according to the invention.

FIG. 1 shows a crane 3 in the form of a gantry crane in which the crane girder 1, configured according to the invention, in the operating position shown is embodied as a main girder which is disposed in a substantially horizontal manner. As is illustrated more clearly in FIG. 4, this main girder 1 has a hollow profile 4 in which the cavity 5 is enclosed by an external wall 6. As can be readily seen in the cross section through the crane girder 1 according to FIG. 4, the external wall 6 of the crane girder is configured having an at least in regions outwardly bulging shape for reducing the aerodynamic drag. In the specific exemplary embodiment, the portions 10 and 11, forming the upper boom and the lower boom, are provided with an outwardly bulging shape. Laterally, the external wall 6 is composed of straight wall portions 12. The main girder 1 according to FIG. 1 supports the trolley 15 to which a lifting gear (not illustrated here), known per se, of the crane is fastened. The trolley 15 is displaceable in the longitudinal direction 27 along the crane girder or main girder 1, respectively. To this end, the crane girder 1 in the first exemplary embodiment shown has two running surfaces 13 along which the two running wheels 14 of the trolley 15 run. As can be particularly readily seen in FIG. 6, the running surfaces 13 here are configured as rails. The running surfaces or rails 13, respectively, are supported on the straight wall portions 12, which may also be referred to as a web or a lateral web, of the external wall 6. Very heavy loads may be brought to bear on the wall portions 12 in particular due to the vertical extent of the latter, without any substantial deformation of the crane girder 1 arising on account thereof. The crane girder 1 in this exemplary embodiment is in any case suspended from the two cross heads 22. In turn, the cross heads 22 by way of supports 21, which are embodied as is the case in the prior art, are supported on the running gears 23. For stabilizing, the supports 21 in the variants shown, are yet again interconnected by horizontal connections 25 above the running gears 23. The horizontal connections 25 may also be referred to as head girders. The crane 3 may be displaced in the movement directions 7 on the running gears 23 which are typically guided on rails. By way of the at least in regions outwardly bulging shape according to the invention of the crane girder 1, the aerodynamic drag of the latter is significantly reduced herein such that drive power for displacing the entire crane 3 including the crane girder 1 may be saved and less drive power is required. The crane girder 1 in the exemplary embodiment shown is elongate in the longitudinal direction 27. In the case of the gantry cranes illustrated here, the movement direction 7 thus runs so as to be orthogonal to the longitudinal extent 27.

Figure 2:
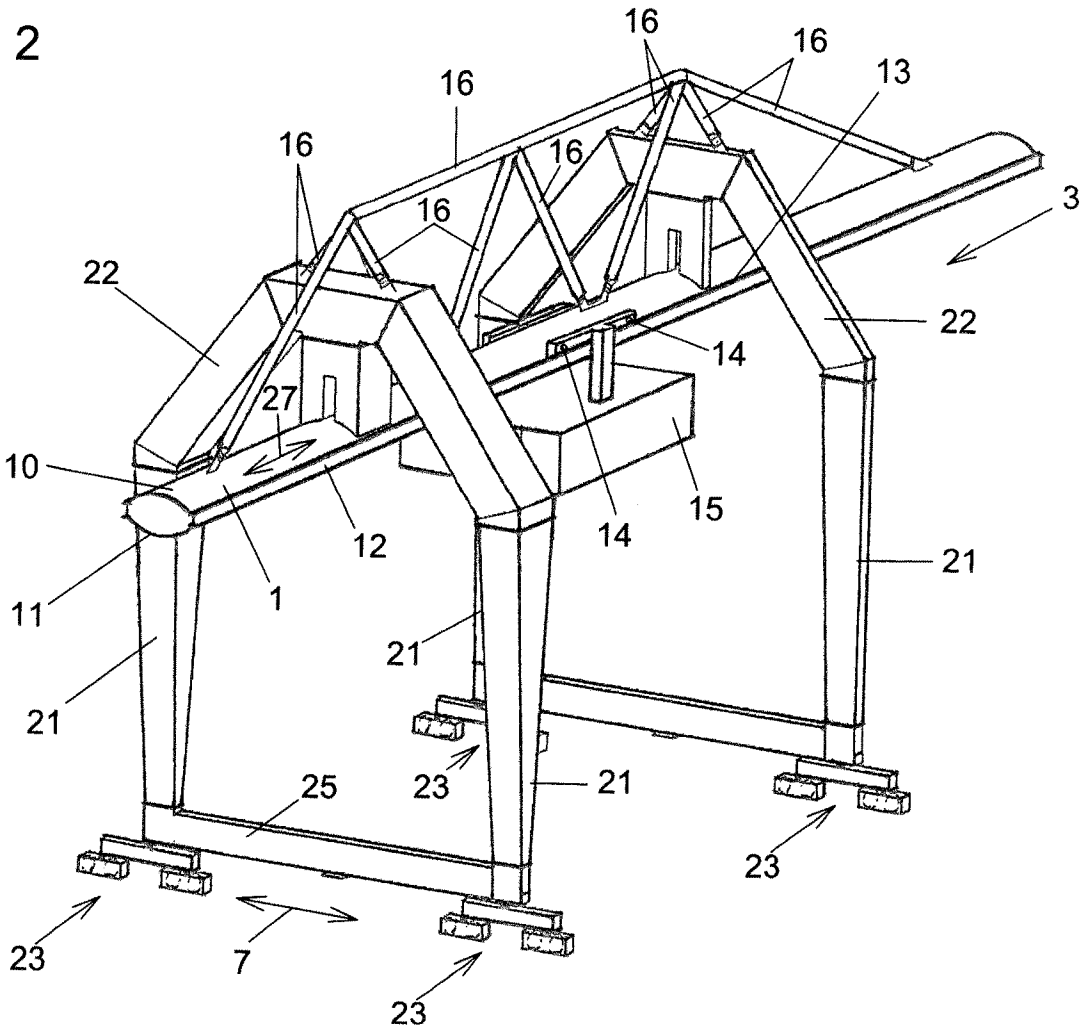

FIG. 2 shows an exemplary embodiment of a gantry crane having only one main girder, which in terms of the basic construction is similar to FIG. 1. Only the points of differentiation in relation to FIG. 1 will be discussed here. Otherwise, the narrative of FIG. 1 applies. The substantial point of difference between the exemplary embodiment according to FIG. 1 and that according to FIG. 2 lies in that a bracing known per se is provided by means of the stays 16 in FIG. 2, the crane girder 1 being additionally suspended from said bracing. This is expedient when particularly heavy loads are to be hooked to the trolley 15 and to be transported by the latter, and/or when the crane girder 1, as illustrated here, in the horizontal direction projects very far beyond the intermediate space between the supports 21, that is to say has a very large longitudinal extent in the longitudinal direction 27.

Figure 3:
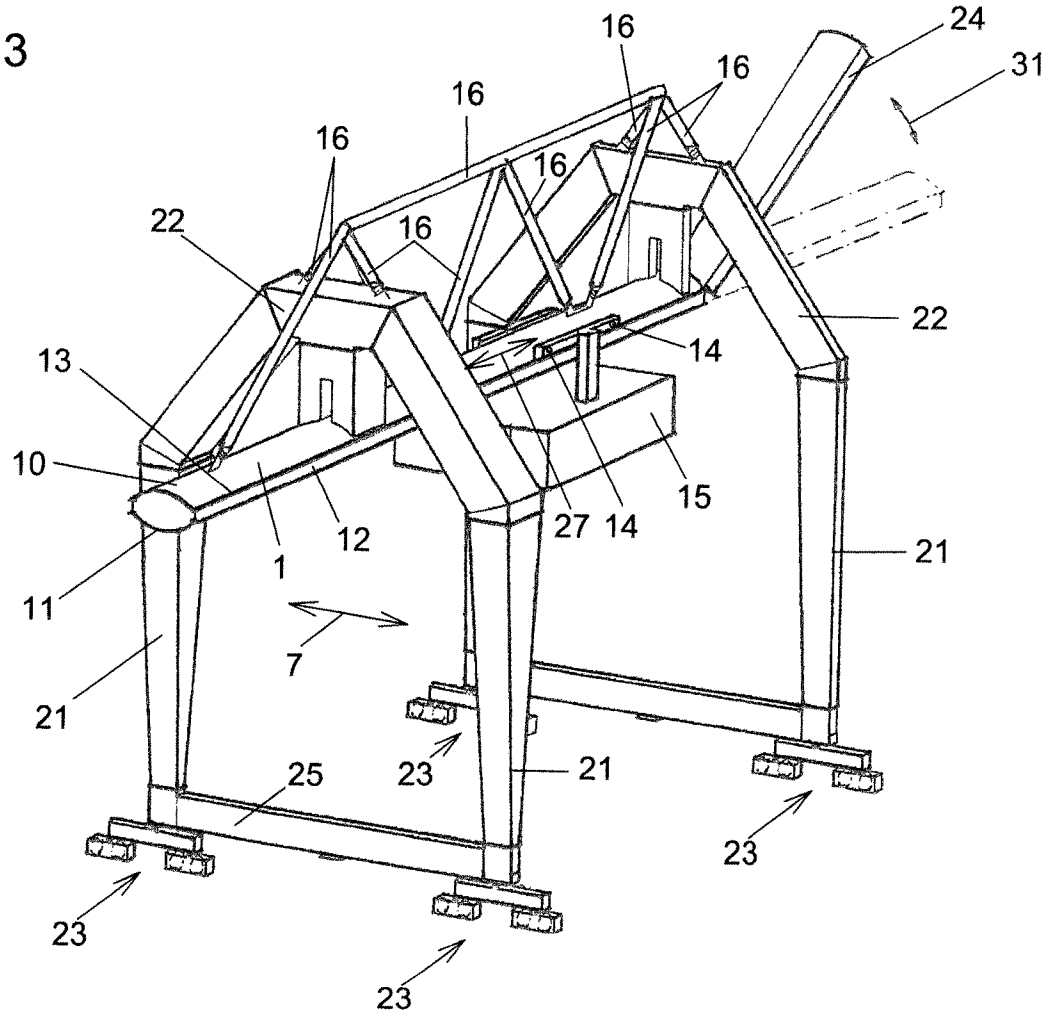

The exemplary embodiment of FIG. 2 is further modified in FIG. 3. Here, the crane girder 1 according to the invention has a crane-girder portion 24 which additionally is pivotable in the vertical direction indicated by the double arrow 31. The drive for pivoting the crane-girder portion 24 in the directions according to the double arrow 31 is not plotted here. This drive may, however, be embodied as is known per se. In this exemplary embodiment according to FIG. 3, the at least one crane-girder portion 24 of the crane girder 1 may thus not only be moved in the movement direction 7, but also in the movement direction according to the double arrow 31. Nevertheless, the crane girder 1 here is also embodied such that the latter during displacement of the crane 3 including the crane girder 1 in the movement directions 7 leads to a corresponding reduction of the aerodynamic drag and thus to a reduction of the required drive power. However, FIG. 3 is also an example for a crane 3 according to the invention not necessarily having to be a gantry crane. Rather, the crane-girder portion 24 is a crane girder of an outrigger crane. The exemplary embodiment according to FIG. 3 is thus a combination of a gantry crane and an outrigger crane.

The invention may of course also be implemented in the case of numerous other crane types, in particular in the case of overhead cranes and other outrigger cranes, without this having to be explicitly illustrated here in more detail.

Figure 4:
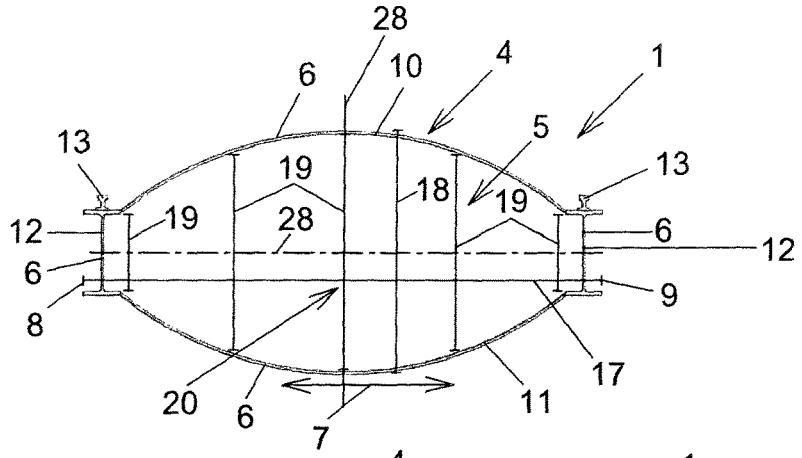
FIG. 4 shows a cross section through the crane girder shown in FIGS. 1 to 3.

As mentioned, FIG. 4 now shows the cross section through the crane girder 1 which is employed in the exemplary embodiments according to FIGS. 1 to 3. The illustrated cross section is illustrated in a plane that is disposed so as to be normal to the respective longitudinal extent of the main girder 1. This applies also to the cross sections according to FIGS. 5 and 6, which will be explained hereunder.

In the exemplary embodiment according to FIG. 4, the portions 10 and 11, forming the upper and lower boom, are each provided with an outwardly bulging shape for reducing the aerodynamic drag. The portion 10 of the external wall 6 in the operating position illustrated here points upward and ensures that rain water or any other precipitation may, if at all, only accumulate in a very small region of the crane girder 1 toward the rails or the running surfaces 13, respectively. In order for this water to be discharged too, the main girder 1 may be embodied so as to be slightly inclined in the longitudinal direction 27 thereof. The outwardly bulging shape of the portions 10 and 11, apart from reducing the aerodynamic drag, also ensures a high stability of the main girder 1 such that the latter may absorb high static forces without buckling braces or other reinforcements having to be further provided to this end in the interior of the cavity 5 enclosed by the external wall 6. Moreover, the outwardly bulging portions 10 and 11 also reduce the susceptibility of the crane girder 1 to noise generation by way of excitation of vibrations. The crane girder 1 is configured in the shape of the hollow profile 4. The external wall 6 sheathes the cavity 5. In the exemplary embodiment shown, the external wall 6 is assembled from the two already mentioned portions 10 and 11 and the straight wall portions 12. The straight wall portions 12 here in this exemplary embodiment are embodied as H girders, as are known per se from steel engineering. By way thereof, very large forces that are generated by the load bearing on the trolley 15 may be absorbed by way of the running surface 13. In the exemplary embodiment according to FIG. 4, the outwardly bulging shapes of the external wall 6, that is to say the portions 10 and 11, are configured to be rounded. Both the width extent 17 as well as the thickness extent or the height extent 18, respectively, are plotted. The width extent 17 of the external wall 16, when viewed in the direction parallel with the movement direction 7, is delimited by the first end 8 and by the second end 9. When viewed in the cross section through the crane girder, as is illustrated here, the spacing 19, measured orthogonally to the movement direction 7, between mutually opposite portions of the external wall 6, increases at least in regions from the two ends 8 and 9 of the width extent 17 of the cavity 5 toward the central region 20 of the cavity. In an exemplary manner, a few spacings 19, which are to be measured orthogonally to the width extent 17, are plotted here. The cross section of this crane girder 1 has two symmetry axes 28. One of the latter, namely the horizontal symmetry axis, runs parallel with the movement direction 7 and thus also parallel with the width extent 17.

Figure 5:
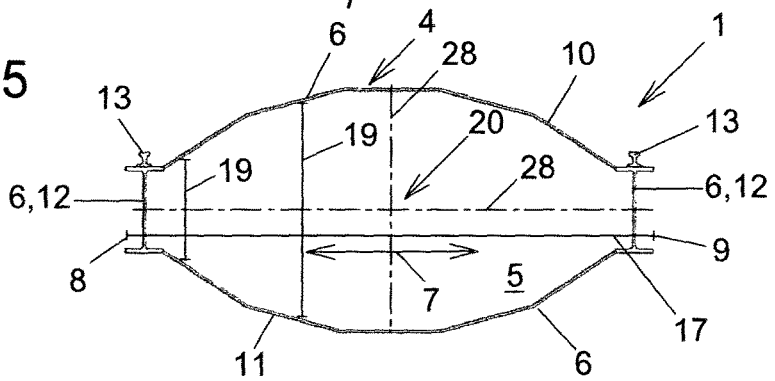
FIGS. 5 and 6 show alternative design embodiments of the above.

FIG. 5 shows a first alternative to the cross section according to FIG. 4. Here, the two mutually opposite upper and lower booms, that is to say the portions 10 and 11, in the cross section shown are not configured to be rounded but to be polygonal, so as to implement the outwardly bulging shape according to the invention of the external wall 6. The narrative mentioned in the context of FIG. 4 applies otherwise.

Figure 6:
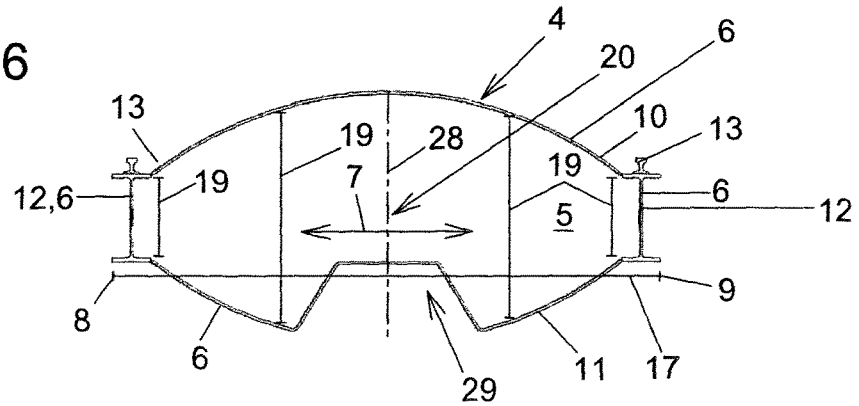

FIG. 6 shows a further variant in the form of a modified embodiment of FIG. 4. Here, a longitudinal groove 29 of the external wall 6 is provided in the lower boom 11. Supply lines or the like may be routed in said longitudinal groove 29 for example. Nevertheless, it applies here too at least in portions, that a spacing 19, measured orthogonally to the movement direction 7, between mutually opposite portions of the external wall 6 increases from the two ends 8 and 9 of the width extent 17 of the cavity 5 toward a central region 20 of the cavity 5.

In the exemplary embodiments according to FIGS. 4 to 6, the cross section through the main girder is embodied so as to be at least primarily approximately lenticular.

LIST OF REFERENCE SIGNS

1 Crane girder
3 Crane
4 Hollow profile
5 Cavity
6 External wall
7 Movement direction
8 First end
9 Second end
10 Portion
11 Portion
12 Straight wall portion
13 Running surface
14 Running wheel
15 Trolley
16 Stay
17 Width extent
18 Thickness extent
19 Spacing
20 Central region
21 Support
22 Cross head
23 Running gear
24 Crane-girder portion
25 Horizontal connection
26 Horizontal connection
27 Longitudinal direction
28 Symmetry axis
29 Longitudinal groove
31 Double arrow

The invention claimed is:

1. A crane girder for a crane, the crane girder comprising a hollow profile, having an external wall that encloses a cavity, and extends longitudinally, and the external wall, when viewed in a cross section through the crane girder, has at least in regions an outwardly bulging shape for reducing aerodynamic drag, the external wall, when viewed in the cross section through the crane girder, has two mutually opposite portions, having an outwardly bulging shape, which are interconnected by two mutually opposite straight wall portions of the external wall, and at least one running surface adapted to support at least one running wheel of a trolley of a lifting gear of the crane, the mutually opposite portions, having an outwardly bulging shape, in an operating position of the crane girder point upward and downward, and the straight wall portions in the operating position laterally delimit the crane girder, the straight wall portions extend vertically, the running surface is at least one of disposed or supported on one of the straight wall portions of the external wall, and a thickness extent of the external wall in a vertical direction, when viewed in the cross section through the crane girder, is between 50% and 80% of a width extent of the external wall in a horizontal direction.

2. The crane girder as claimed in claim 1, wherein the crane girder is movable in at least one movement direction, and a width extent of the external wall of the crane girder is delimited in parallel with the movement direction by a first end and a second end of the width extent, and when viewed in the cross section through the crane girder a spacing, which is measured orthogonally to the movement direction, between two mutually opposite portions of the external wall at least in regions increases from at least one of the ends of the width extent of the cavity toward a central region of the cavity.

3. The crane girder as claimed in claim 2, wherein the spacing between the two mutually opposite portions of the external wall at least in regions increases from both of the ends of the width extent of the cavity toward a central region of the cavity.

4. The crane girder as claimed in claim 1, wherein the shape of the external wall that at least in regions is outwardly bulging, when viewed in the cross section through the crane girder is configured to be rounded.

5. The crane girder as claimed in claim 1, wherein the shape of the external wall that at least in regions is outwardly bulging, when viewed in the cross section through the crane girder is configured to be polygonal.

6. The crane girder as claimed in claim 1, wherein the running surface is configured as a rail.

7. A crane comprising at least one crane girder as claimed in claim 1.

8. The crane girder as claimed in claim 1, wherein the running surface is at least one of disposed or supported on top of one of the straight wall portions of the external wall.

* * * * *